US009550101B2

(12) United States Patent
Janeri

(10) Patent No.: US 9,550,101 B2
(45) Date of Patent: Jan. 24, 2017

(54) COMBINATION GAME THROWING TARGET AND CHAIR AND METHOD OF ASSEMBLY

(71) Applicant: John Janeri, Cary, NC (US)

(72) Inventor: John Janeri, Cary, NC (US)

( * ) Notice: Subject to any disclaimer, the term of this patent is extended or adjusted under 35 U.S.C. 154(b) by 93 days.

(21) Appl. No.: 14/328,589

(22) Filed: Jul. 10, 2014

(65) Prior Publication Data

US 2016/0008689 A1 Jan. 14, 2016

(51) Int. Cl.

| | |
|---|---|
| ***A63B 63/00*** | (2006.01) |
| ***A63B 67/06*** | (2006.01) |
| ***A47C 4/08*** | (2006.01) |
| ***A47C 15/00*** | (2006.01) |
| *A47C 1/14* | (2006.01) |
| *A47C 7/62* | (2006.01) |

(52) U.S. Cl.

CPC ..... *A63B 67/06* (2013.01); *A47C 4/08* (2013.01); *A47C 15/004* (2013.01); *A47C 1/14* (2013.01); *A47C 7/62* (2013.01); *A63B 63/00* (2013.01)

(58) Field of Classification Search

CPC ..... A47C 1/143; A47C 4/40; A63B 63/00; A63B 63/08; A63B 67/06

USPC ..... 273/398–402; 297/16.2, 22, 23, 31

See application file for complete search history.

(56) References Cited

U.S. PATENT DOCUMENTS

| | | | | | |
|---|---|---|---|---|---|
| 363,404 | A * | 5/1887 | Marston | A47C 4/40 | 297/23 |
| 1,348,262 | A * | 8/1920 | Brockway | A63H 3/52 | 108/11 |
| 2,467,287 | A * | 4/1949 | Backlund | A47C 4/24 | 297/31 |
| 2,615,501 | A * | 10/1952 | Neiborn | A47C 16/005 | 297/153 |
| 3,301,596 | A * | 1/1967 | Eos | A47C 1/143 | 297/16.2 |
| 4,015,778 | A * | 4/1977 | Chen | A47C 4/24 | 273/284 |
| 5,246,265 | A * | 9/1993 | Nagan | A47C 3/38 | 297/31 |
| 5,779,570 | A * | 7/1998 | Bear | A63B 63/08 | 273/401 |
| 6,595,589 | B2 * | 7/2003 | Cochran | A61G 15/007 | 297/16.2 |
| 6,860,567 | B1 * | 3/2005 | Bauer | A47C 1/143 | 297/144 |
| 6,938,287 | B1 * | 9/2005 | Mahshie | A47C 17/66 | 297/900 |
| D526,497 | S * | 8/2006 | Snell | D6/358 | |
| 7,963,592 | B1 * | 6/2011 | Stanley | A47C 20/026 | 297/188.04 |
| 8,186,754 | B2 * | 5/2012 | Sharrow | A47C 4/04 | 297/19 |
| 8,528,910 | B2 * | 9/2013 | Escobar | A63B 63/08 | 273/398 |

(Continued)

*Primary Examiner* — Mark Graham

(74) *Attorney, Agent, or Firm* — Daniel Becker

(57) ABSTRACT

An apparatus in which propping mechanisms and seat mechanisms augment a throwing game target with the ability to alternately function as a chair when it is not in use as a target. The throwing target components, the components of the propping mechanisms, and the components of the seat mechanisms are all capable of collapse or removal to facilitate the apparatus to be carried, transported or stowed.

2 Claims, 7 Drawing Sheets

(56) References Cited

U.S. PATENT DOCUMENTS

| | | | | |
|---|---|---|---|---|
| 8,708,406 | B1 * | 4/2014 | Powell | A47C 21/00 297/188.06 |
| 2015/0273301 | A1 * | 10/2015 | Zierenberg | A63B 67/06 273/402 |

* cited by examiner

COMBINATION GAME THROWING TARGET AND CHAIR AND METHOD OF ASSEMBLY

FIELD OF THE INVENTION

The invention relates to the fields of games, throwing games, outdoor leisure equipment, chairs, and folding chairs. The invention discloses an apparatus which generally provides the benefits of at least two of these fields, being a target for a game, a part of a game involving a projectile or throwing, is used outdoors, amongst a group of people casually gathering and their methods and devices accompanying such a gathering, provides an object to sit upon, and being a seat which folds.

BACKGROUND OF THE INVENTION

The invention is an improvement of a throwing target used in recreation games in which players throw objects at a target. The conception of the claimed invention occurred during a moment in which the inventor experienced a problem inherent in the use of a target for a throwing game. While the invention disclosed herein may be realized in a variation that uses another throwing target, the invention, at its initial conception, contemplated modification of the throwing target used in the game referred-to as "Cornhole." Hereafter, it is written as merely cornhole.

The target for playing cornhole is generally constructed from five parts. Four are straight lengths of constant section material forming a frame, and the fifth is a panel that lies atop the frame. Toward one end of the face, there is a hole for receiving a thrown object. To increase the view factor to the hole, the target face is inclined upward from the ground at the end at which the hole is located. Specific to cornhole, the thrown object is generally expected to be a bean bag, a pouch containing free media that fills the bag but does not so entirely fill it that the bag loses the ability to deform when it strikes a surface.

A bean bag does not deform and then resiliently recoil to an uncompressed shape. This gives it the general ability to engage a surface, without bouncing away from the surface. The ability to deform and remain in contact with a surface allows a bean bag striking the target face to generally slide across the surface, rather than roll. Use of a bean bag therefore allows for the game of cornhole to be free of impact deflection and instead include friction as a variable in achieving the task of delivering a thrown object into a target hole. Locating the target's hole closer to the inclined end, furthest from the bag-thrower, allows for most of the rest of the board to be used as a runway of greater area than the hole, which can compensate for errors in angle of trajectory and for distance of the thrown to make use of the greater area of the rest of the board to allow the excess velocity to keep the bag on the surface and occasionally carry the bag into the hole.

It is not uncommon for points to be allocated for bags which strike the target face and remain on the surface, in lieu of actually passing through the hole. Thrown too fast, a bean bag may skip-over the hole. Thrown too slowly or at too steep a trajectory, a bean bag may come to land on the target but not manage to slide up the face into the hole, for its relative lack of horizontal component of its velocity. However, a steep trajectory does increase the odds of a bean bag remaining upon the target surface, because of the friction and force-absorbing deformation of the bag preventing the smaller horizontal component from carrying the bag off of the surface.

Cornhole, because of its simple and generally affordable target assembly cost, and commonly expected proportions of gameplay, has become very popular. A large portion of the public can build a conforming board, and for minimal financial burden. As a result, individuals of a larger proportion of the public, stumbling upon a game of cornhole, is more likely to have played the game on a similar target, and wish to join-in, because of the greater odds of having accumulated skill from having played on another occasion, in a different location, with a different group of people. The regulation of proportions and their selection in order to enable use of simplest materials therefore fosters popularity.

The lack of additional equipment and moderate distance of the field necessary for gameplay lends itself to outdoor leisure events and social gathering. Two common settings for cornhole are beaches and parking lots at sporting events in which fans are engaging in the generally-pre-game social gathering practice known as "tailgating." Someone "tailgaters" may bring food for others, some may bring drink, others games, and others may be expected to bring chairs, in order for such a group to share in all of these benefits during the event. The inventor conceived of the present invention when attending a tailgating event, to which the inventor was carrying a target for cornhole from a significant distance. He was burdened with both carrying a cornhole game target and folding chairs, so that people not playing the game could sit, as well also other items to be used at the event, but which themselves were not pertinent to playing cornhole.

The game of cornhole is played standing up, so those participating in gameplay do not require a chair. However, between games, or after game play has ceased, anyone that might have been standing up would then need a chair. Any chair provided for an individual that begins playing the game would therefore be vacant during gameplay. Therefore, chairs and game targets are alternately necessary. Using a game target is in the alternative to a chair and vice-versa. Certainly, both could be provided. However, providing both chair and target requires undertaking the burdens of carrying the weight of both, and providing sufficient space in a vehicle for both, if carried in a vehicle. The space limitation is significant in the likely scenario of the additional chairs for attendees that will be present but not playing the game. It is the nature of playing cornhole as a part of an event that it will need to be provided space alongside other space-consuming objects, like chairs. While any single cornhole target is likely to be only modestly heavy and conveniently shaped for carry for individuals with two arms to commit to the task, it becomes dramatically more difficult to handle when said individual also must carry another object.

The prior art includes throwing targets that attempt to address the size and weight and shape limitations of a cornhole board by compromising the cornhole board. In most variations, the dimensions are significantly changed, and often the gameplay is negatively affected by the space saving features. One corruption of the continuous surface of a typical cornhole throwing target would be dividing the playing surface up the face of the board, along its length, with a hinge, as seen in published application "Portable bean bag toss game (Nally, 2014/0091526)."

A common example of a successful throw is one which lands on the middle of the board and has enough velocity to slide up the middle of the board, into the hole. A hinge running up the middle of the board negatively affects the throw, and denies reward to a performance that is generally capable of obtaining a goal on an uncompromised target. More detrimental to the desire to use such a target to play cornhole, or any other bean bag toss game, is not the corruption of the play caused by a feature that corrupts the playing surface, but the fact that the detrimental feature is not present in other cornhole targets. If the game target varies, the appeal of carryover skill or other familiarity-related appeal is not available, and fewer people have interest in playing the game. A high priority to an improvement in providing the target is to not compromise the target's conformance to common gameplay.

Taken in sum, the inventor recognized a general need to decrease the overall burden of providing cumulative objects to an event in which cornhole might be played, rather than alter a cornhole target's gameplay parameters. The decrease in the quantity of objects decreases the cumulative burden frequently present in any event in which cornhole might be provided. Folding chairs are one object carried that are only necessary during periods, when gameplay is not occurring. Therefore, combination of the two objects, the target and a chair, decreases the quantity of objects, wherein such combination sufficiently performs the ability to alternately provide an acceptable chair or an acceptable cornhole target.

The invention, as disclosed in the summary of the invention, and the detailed description of the invention, and as claimed, addresses the problem of reducing the burden of providing a throwing target. It provides, in a single apparatus, both an acceptable chair and an acceptable cornhole target, in the alternative.

SUMMARY OF THE INVENTION

The invention is generally capable of being described as an apparatus formed by augmenting a throwing game target with supplemental systems to enable it to alternately function as a chair, when not in use for its original purpose as a target.

In order to provide the function of a chair seat, the apparatus has to locate the back and the lower-body of an occupant, meaning his posterior and thigh. The invention comprises propping means, which appear in the drawings as a pair of pivoting legs that are similar in construction and method of deployment to the shorter legs used to elevate the surface of the depicted throwing game target in its original function as a game target. The propping legs are sufficiently long to elevate the target to an angle steep enough for the target to serve as a backrest. The apparatus also provides a seat mechanism structure which, in combination with the target's structure, can adequately support the weight of an occupant.

The embodiment of the seat mechanism depicted in the figures uses a two-piece linkage on either side of the target that can provide triangulated support geometry when the terminus of the second linkage is adequately located with respect to the ground and/or the bottom of the throwing target. A panel can be applied to the top of the linkage in order to facilitate a sufficiently large area to receive the posterior and thigh of an occupant, in order to comfortably translate the weight of the occupant to the ground through the upper part of the seat mechanism linkage and then down to the ground through both the target and the lower part of the seat mechanism linkage. Both the propping means and the seat mechanism pivot, collapse, retract, or can be removed with respect to the target so that it can be carried. In the depicted embodiment, and as a preferred aspect of the invention, use of the apparatus as a target for play is not altered by augmentation of the target with propping and seat mechanisms.

The target envisioned as the best mode is one suited to perform as the target of a popular throwing game known as "Cornhole." The target used in cornhole begs augmentation because its dimensions and structure demonstrate the overall inconveniences encountered in the tasks inherent to the endeavor that include providing the target to the setting in which the game is likely to be played. The target used in cornhole also lends itself to application of the additional systems disclosed because the dimensions and structure that give rise to the inconveniences recited are of adequate size and strength to serve as part of the load-bearing structure of a chair.

It is foreseen that the apparatus, as claimed, is capable of being rendered by similar application of propping and seat means to other throwing game targets. Potential game targets are numerous, and it should be recognized that the modifications applied here are somewhat more dependent upon a game target having a suitable proportion and shape in order to be so modified.

Throwing, generally referring to projection of an object through an arc through the air and returned to earth by gravity, does not limit the modifications disclosed here from applying to other foreseeable suitable target surfaces. Sliding or rolling or hitting an object toward a target, such as in shuffleboard and bowling or skeeball or baseball or cricket, are all meant to be included in the word "throw." Also, while embodiments depicted herein use target surfaces that are predominantly flat, the fact that a game's playing surface is not entirely flat, as in skeeball, does not prevent part or all of it as being capable of being propped to serve as a backrest or receiving a seat mechanism.

BRIEF DESCRIPTION OF THE DRAWINGS

The invention is best understood according to the embodiment depicted in the drawings and described in the detailed description of the drawings, referring to at least one mode of its form as an apparatus. This mode is considered the preferred embodiment because it anticipates use with respect to a particular popular throwing game, the bean bag game known as "cornhole." This embodiment is also preferred because the apparatus is assembled in a manner that preserves gameplay-parameters of the throwing game, to keep it in conformance with other cornhole targets. These drawings should be considered an exemplary form of practicing the claimed invention. However, alternate embodiments are contemplated, and are further discussed below.

For example, an embodiment of a seat panel, contemplated but not shown, is one in which the seat panel disclosed in the drawings is replaced with any otherwise equivalent structure suitable to locate a panel with respect to a supportive periphery or series of cross beams or other support truss or support system. In particular, the inventor envisions embodiments that locate the rails of a seat panel at identical distance to one another as the distance at which the thigh links are located relative to one another. In the drawings, the seat panel structure fits within a supportive periphery and the elements of the panel's structure is located by contact with the inner faces of the periphery. If the support structure of the panel was spaced to the same spacing of the supportive periphery, the rails of that seat panel, when applied to the top of the supportive periphery, would line up directly above supportive periphery. In that case, to securely locate the panel relative to the supportive periphery, the elements of the support structure of the panel could utilize pegs, extending from the bottom of the rails, to insert into holes located on corresponding positions on the top face of the supportive periphery.

Figure 1:
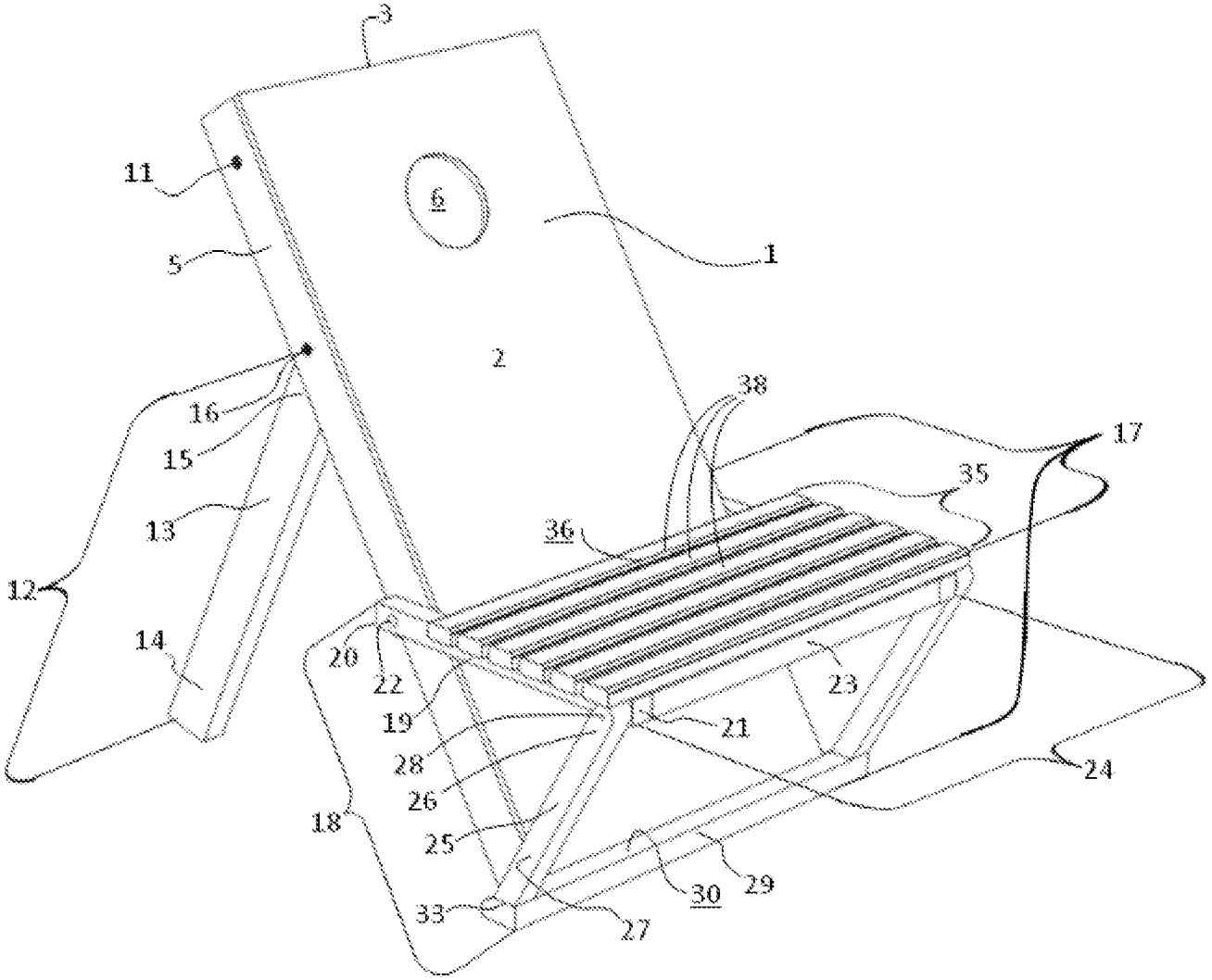

Components of the apparatus are labeled with reference numerals. Underlined numerals indicate that they label a specific surface of an object, or a region of a surface, (such as a substantially planar hole in a surface), rather than an object itself.

Figure 2:
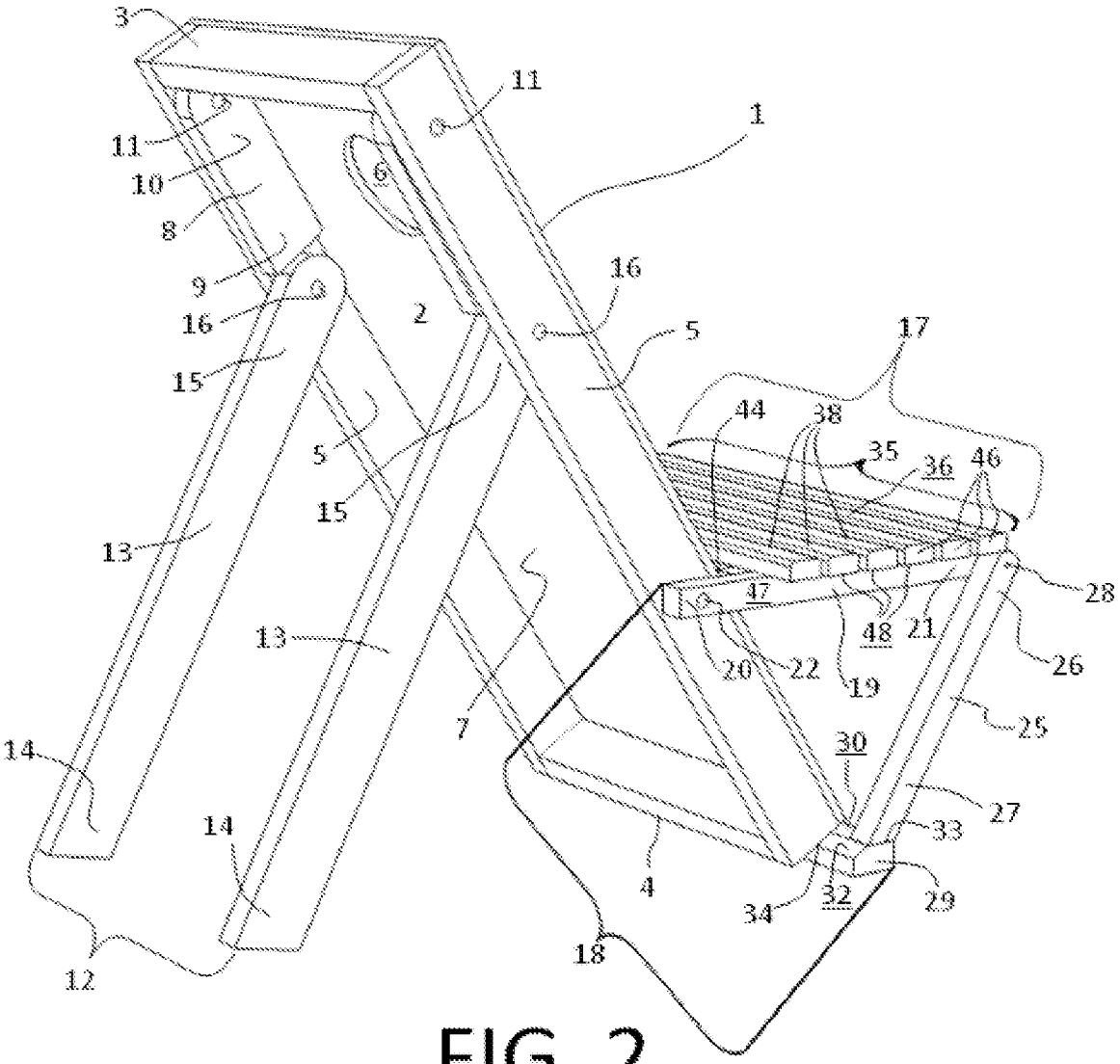
Figure 3:
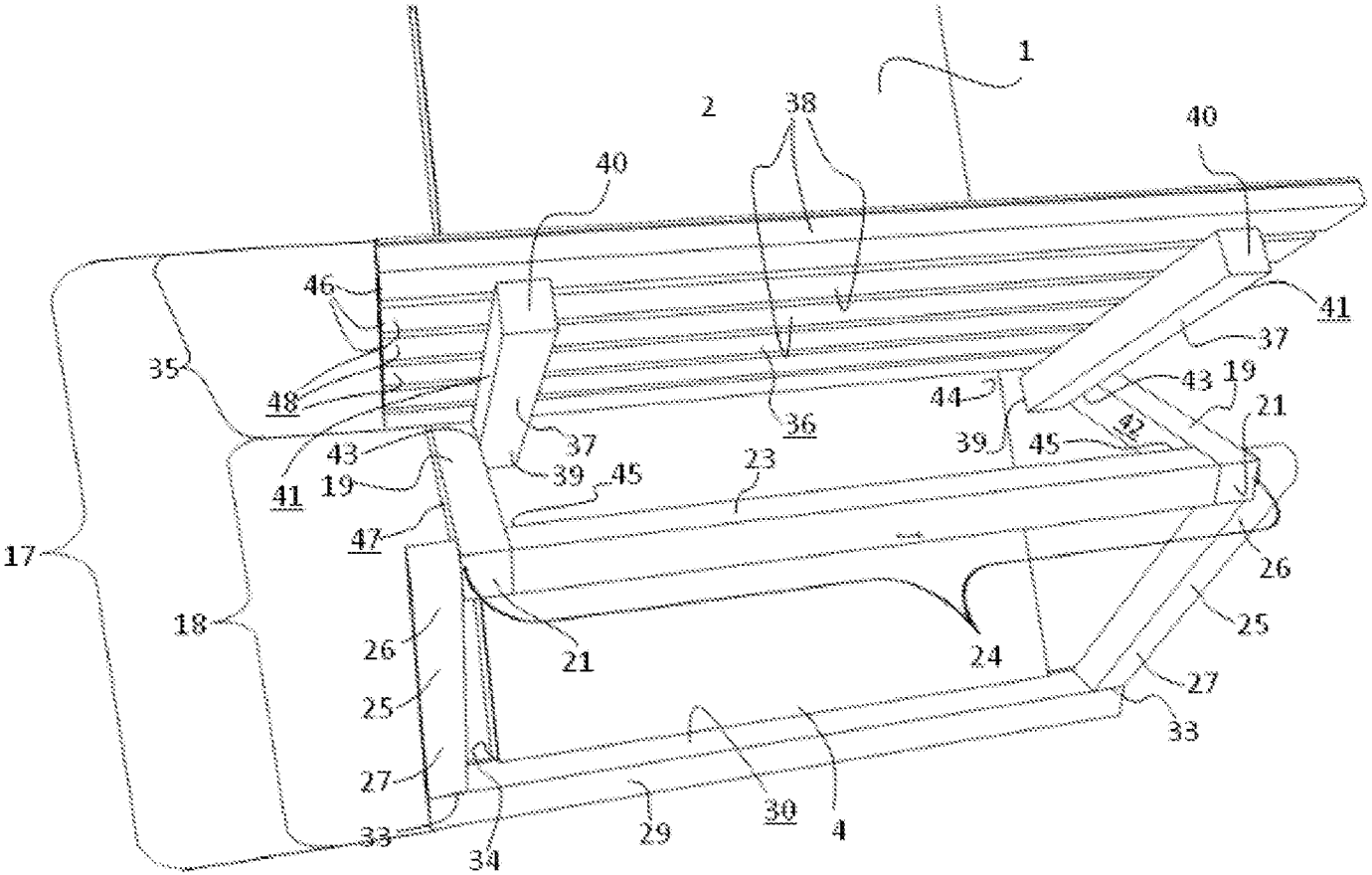

FIG. 1 is a view of the front and side of the apparatus, erected into a chair;

FIG. 2 is a view of the rear and side of the apparatus, erected as a chair;

FIG. 3 is a perspective view of the apparatus from above, slightly to one side of the front of the apparatus, with an embodiment of a seat panel partially installed.

Figure 4:
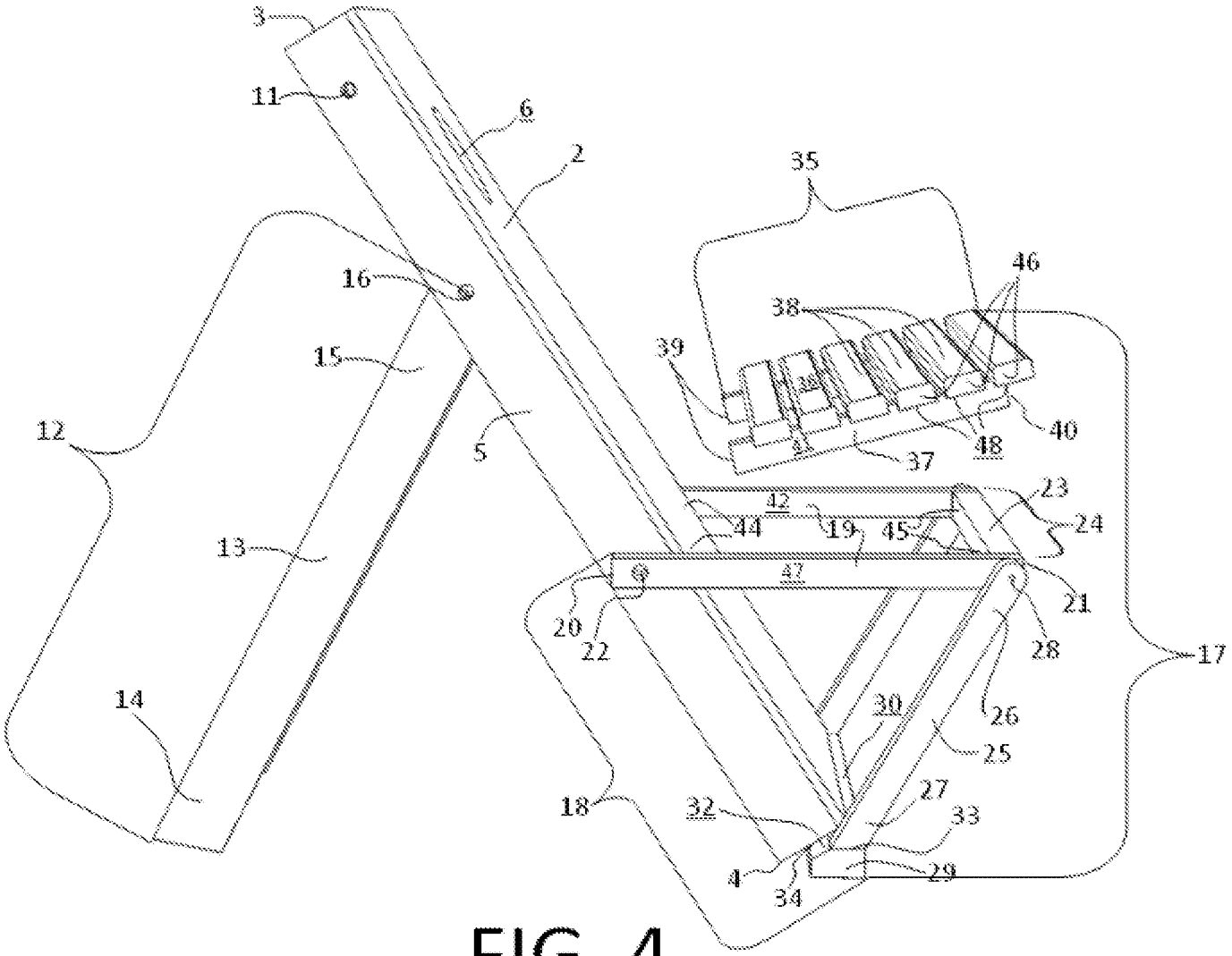

FIG. 4 is a side view of the apparatus from slightly above the apparatus, showing an embodiment of a seat panel at an exemplary position and angle relative to the apparatus to show a seat panel in mid-assembly.

Figure 5:
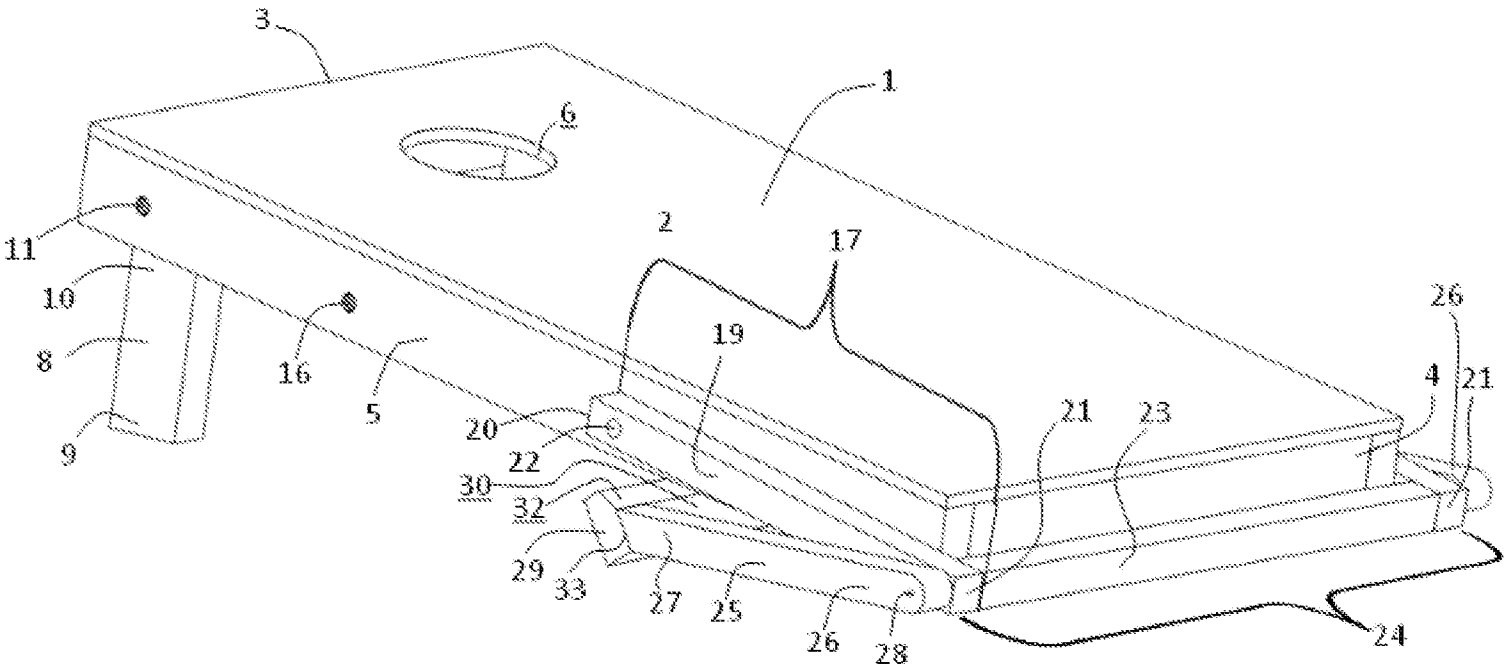
Figure 6:
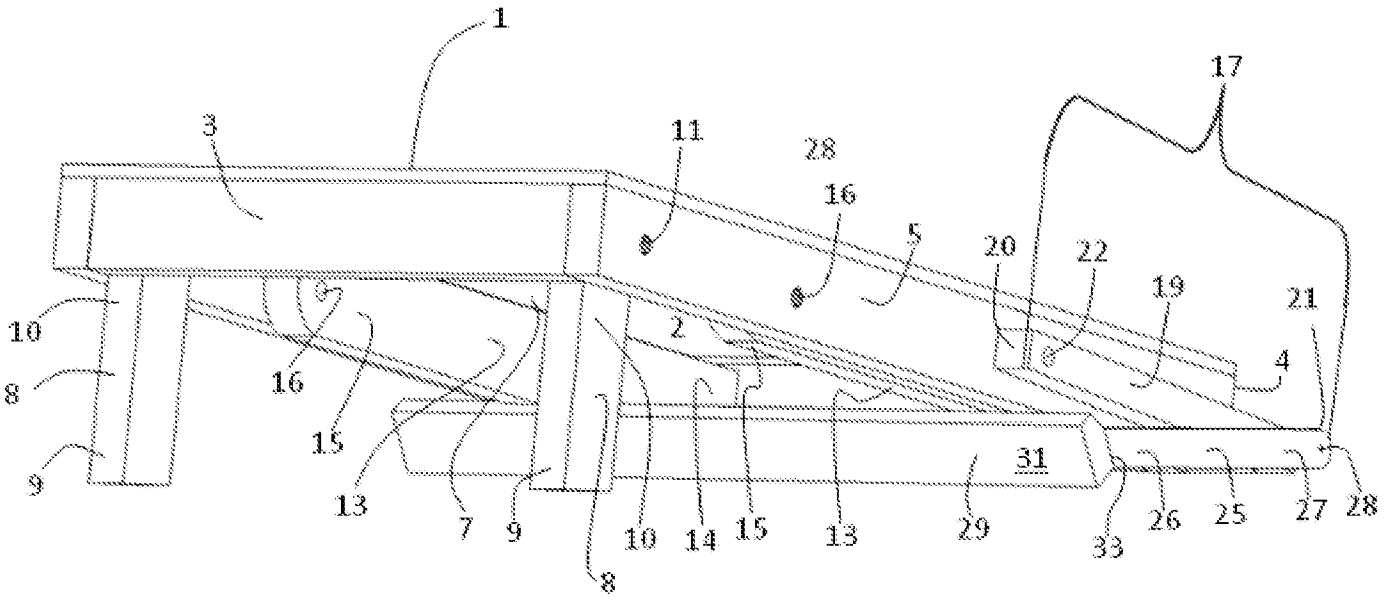
Figure 7:
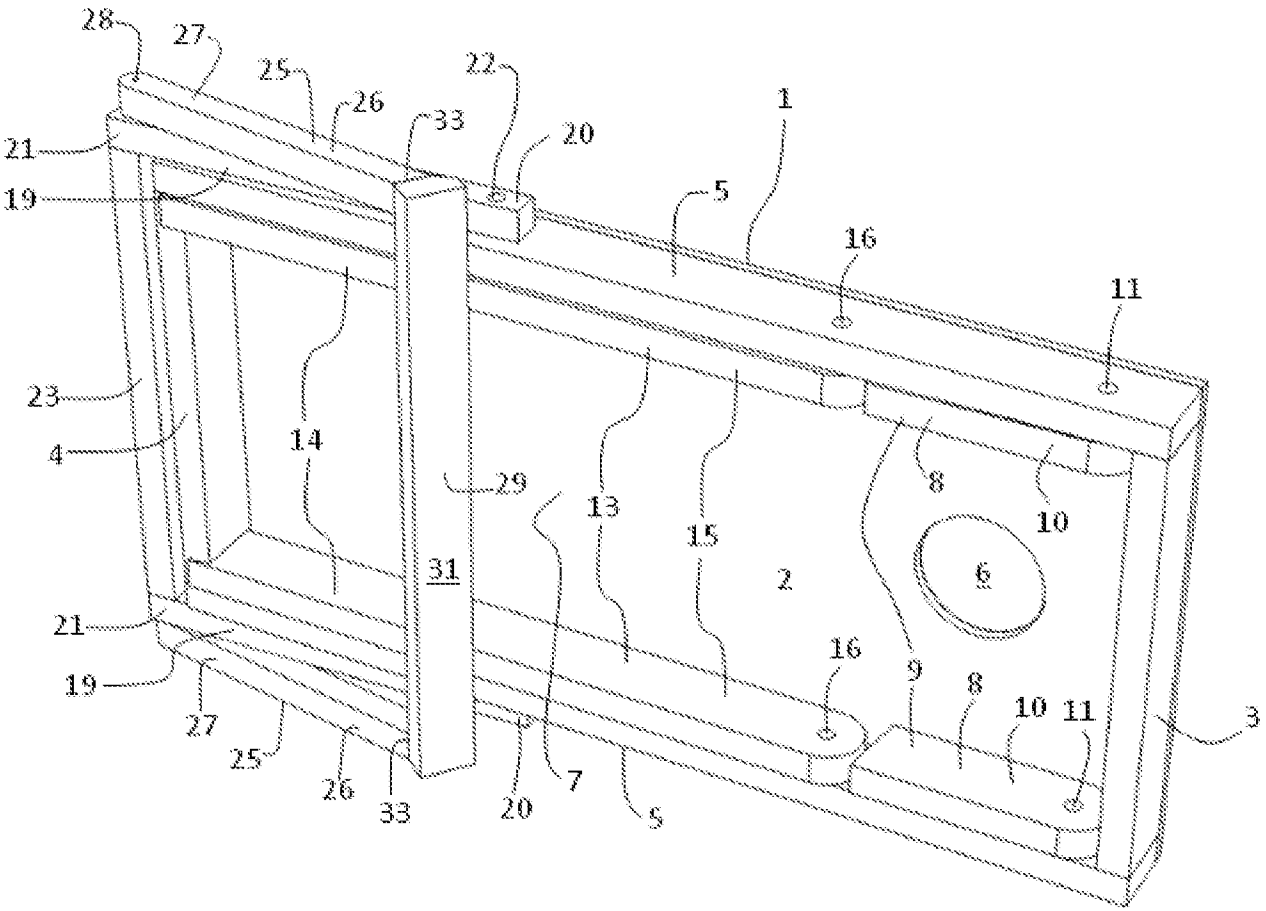

FIG. 5 is a front and side view of the apparatus as positioned for use as a throwing game target;

FIG. 6 is a rear and side view of the apparatus, with chair-components collapsed within, laid low to function as a throwing game target;

FIG. 7. is a view showing the apparatus with components folded and on its side, ready to be carried.

DETAILED DESCRIPTION OF THE DRAWINGS

The drawings depict an embodiment of the apparatus form of the present invention, depicted in FIGS. 1-7, presents an apparatus that comprises three subassemblies, a target (1), a prop mechanism (12), and a seat mechanism (17).

The target (1) comprises a face (2), upon which a target hole (6) is located, and a periphery consisting of a top (3), a bottom (4), and two sides (5). The top (3), bottom (4), and sides (5) each have an interior and exterior plane. The interior planes of the top (3), bottom (4), sides (5), and the face (2) define a volume, the interior (7). The target (1) also comprises target legs (8), each having a foot end (9) and a pivot end (10). Each target leg (8) is pivotably secured to the target (1) at the junction (11) of the pivot end (10) of the target leg (8) and the interior plane of a side (5).

With specific reference to FIGS. 5 and 6, in which the apparatus is positioned for gameplay, the target legs (8) are articulated about their pivot ends (10) at the junction (11), such that the foot ends (9) can engage the ground. The junction (11) is positioned near the top (3) of the target (1), so that when the apparatus is lowered to the ground, the target legs (8) locate the top (3) further from the ground, relative to the bottom (4), moderately inclining the target (1) relative to the ground, including its face (2) and its sides (5).

Using the apparatus for a bean bag toss game, as shown in FIGS. 5 and 6, would use the moderate inclination of the target (1) to allow the large area of the face (2) to function as a runway in throwing a bean bag into the hole (6), to include friction as a factor in playing the throwing game.

Referring to FIG. 2, the prop mechanism (12) depicted in the drawings comprises prop legs (13), each having a foot end (14) and a pivot end (15). Each prop leg (13) is pivotably secured to the target (1) at the junction (16) of the pivot end (15) of the prop leg (13) and the interior plane of a side (5). The junction (16) is located at a lengthwise position along the sides (5) that is closer to the bottom (4) of the target (1) than the junction (11) for the target legs (8).

With respect to FIGS. 1-4, in the method form of the invention, target (1), as augmented with the propping mechanism (12) and the seat mechanism (17), is articulated into the mode of a chair. The top end (3) of the target (1) is elevated, the prop legs (13) are articulated out of the interior (7) about their pivot ends (15) at the junction (16), such that the foot ends (14) can engage the ground.

In the method form of the invention, during the step of elevating the target (1) away from the ground, the prop legs (13) are sufficiently long, relative to the length of the target (1), to significantly elevate the top (3) relative to the bottom (4), to incline the target (1), including its face (2) and its sides (5), to a steep angle, and locate and support it in that position. Using the apparatus for a chair, as shown in FIGS. 1-2, would use the significant inclination of the target (1) to allow the large area of the face (2) to function as a backrest, to approximate an angle acceptable for a backrest.

With respect to FIGS. 1-4, in which the apparatus is shown in modes of operation other than for function as a target in a throwing game, the target legs (8) are not used, and are pivoted about their pivot ends (10) at the junction (11), so as to be either predominantly located within the interior (7) or at least otherwise suspended by their pivot ends (10) high enough that they do not engage the ground. Likewise, in FIGS. 5-7, in which the apparatus is shown in modes of operation other than for function as a chair, the prop legs (13) are not used, and are pivoted about their pivot ends (15) at the junction (16), so as to be predominantly located within the interior (7).

With respect to FIGS. 2-4, the seat mechanism (17) depicted comprises two components, a linkage (18) and a seat panel (35). The linkage (18) of comprises two pairs of pivoting links, one on each side of the apparatus. The first links are thigh links (19) and the second links are calf links (25).

The thigh links each comprise a hip end (20) and a knee end (21). Each thigh link (19) is pivotably connected at its hip end (20) to the exterior plane of the side (5) of the target (1) at a junction (22). Between the sets of links, the knee ends (21) of the thigh links (19) are connected by a crossmember (23). The addition of the crossmember (23) to the thigh links (19) forms a supportive periphery (24).

The calf links (25) each comprise a knee end (26) and a foot end (27). The knee ends (26) of the calf links (25) are pivotably connected to the knee ends (21) of the thigh links (25) at pinned junctions (28). Between the foot ends (27) of each calf link is a wedged foot (29).

The wedged foot (29) comprises a top face (30), a bottom face (31), and a wedge face (32). The calf links (25) engage the top face (30) of the wedged foot (29). In FIGS. 1-4, in which the apparatus is depicted as articulated to function as a chair, the target (1) is significantly elevated, with the target face (2) significantly inclined relative to the ground, so as to function as a backrest. In this position, the thigh links (19) are pivoted so as to be predominantly parallel to the ground, and the calf links (25) are pivoted relative to the knee junctions (28) as to locate the wedged foot (29) under the bottom (4) of the target (1).

As depicted in FIGS. 1-4, the wedge face (32) of the wedged foot (29) comes into substantial contact with the bottom (4) of the target (1) at a contact region (34), and the bottom face (31) of the wedged foot (29) comes into substantial contact with the ground. In this position, the wedged foot (29) occupies the space between the ground and the bottom (4) of the target (1), and is vertically loaded at both its wedge face (32) by forces communicated through the bottom (4) of the target (1) and at its top face (30) by forces communicated through the foot ends (27) of the calf links (25). In this position, the target (1) and calf links (25) can then bear substantially equal vertical loads applied to the seat mechanism.

With respect to FIGS. 3 and 4, one embodiment of a seat panel (35) is shown, comprising a surface (36) and rails (37). The rails (37) have a first end (39) and a second end (40) and exterior faces (41). The surface (36) provides an area to receive a user, the area provided by slats (38). The slats (38) have overhanging ends (46) that provide the surface (36) with greater area than would otherwise be available within the perimeter of the supportive periphery (24).

Specific to FIG. 3, the seat panel (35) is shown partially-applied to the supportive periphery (24) by fit tolerances and frictional contact. The thigh links (19) have interior faces (42). When inserted, the exterior faces (41) of the rails (37) come into close, frictional, sliding contact with the interior faces (42) of the thigh links (19) at contact regions (43).

FIG. 3 shows the contact points and fits of the components of the seat panel (35) with respect to the rest of the apparatus. During insertion, the first ends (39) of the rails (37) come into contact with the face (2) of the target (1) at contact regions (44) and the second ends (40) then drop down, to reside within the supportive periphery (24). In this position, the second ends (40) of the rails (37) come into close contact with the cross member (23) at contact regions 45.

The method form of the invention comprises the steps of providing the seating mechanism (17) and the propping mechanism (12) to the target (1). The method also comprises the steps of articulating the invention from a chair to a game throwing target and collapsing for transportation. Those steps are inherently disclosed by the progression of the drawings from FIG. 1 to FIG. 6.

FIGS. 1 and 2 show the apparatus fully erected into the chair orientation, with the top (3) of the target (1) having been elevated to a high angle, inclining the target (1) to a high angle. It is located into this position by the steps of providing the propping mechanism (12) and the seat mechanism (17), as shown. Then is performed a step of pivoting the propping legs (13) out of the interior (7), and setting the target (1) onto the propping legs (13), allowing the propping mechanism (12) to locate the target (1) at this angle.

The next steps articulate the linkage into place. The first step pivots the thigh links (19) at the hip junctions (22) to a position in which the thigh links (19) are substantially parallel to the ground. Then next step pivots the calf link (25) about the knee junction, (28) to swing the wedged foot (29) between the bottom (4) of the target (1) and the ground until it is firmly located, the bottom face (31) in contact with the ground, and the wedge face (32) in contact at the contact region (34).

FIGS. 3 and 4 show steps of the method form of the invention which are intermediate to the positions of apparatus positioned to function as either a chair (FIGS. 1 and 2) or as a throwing game target (FIGS. 5 and 6).

In FIG. 3, the seat panel (35) is displayed partially installed, as pivoted upward and slid-forward within the supportive periphery (24). The position of the seat panel (35) was achieved by performance of a step of pulling the seat panel (35) upward, by applying force to the underside faces (48) of the overhanging edges (46) of the slats (38) of the seat panel (35). The underside faces (48) are the areas on the undersides of the slats (38) which extend beyond, and overhang, the outer faces (47) of the thigh links (19). Therefore, FIG. 3, in view of FIGS. 1 and 2, discloses the step of removing the seat panel (35) from its fully installed position, against the sliding friction that exists between the interior faces (42) of the thigh links (19) and the exterior faces (41) of the rails (37), at the contact regions (43).

FIG. 4, in view of FIG. 3, discloses the step of fully removing the seat panel (35) from the supportive periphery (24), so that the only remaining parts of the seat mechanism (17) attached to the apparatus are those of the linkage (18).

FIGS. 5 and 6 depict the apparatus positioned to function as a game throwing target. To achieve this lower height, several steps must be performed. First is a step which pivots the propping legs (13) into the interior (7). Second is a step which folds the linkage (18) under the target (1). Then, a step of pivoting the target legs (8), about the junction (11), pivoting the foot ends (9) out of the interior (7). Then comes a step lowering the top (3) of the target (1) toward the ground, reclining the target (1) to a less steep angle with respect to the ground, and allowing the foot ends (9) of the target legs (8) to engage the ground.

I claim:

1. An apparatus comprising:

a. a throwing game target, comprising:
   i. primary support means for providing a primary position, and
   ii. a large and substantially planar surface area, b. Secondary support means for supporting said throwing game target in a secondary position, wherein:
   i. Said secondary support means comprise a collapsible propping mechanism that positions said throwing game target in said secondary position, c. Seat means for enabling said throwing game target, positioned at said secondary position, to offer sufficient strength and shape to function as a chair, wherein:
   i. Said seat means are collapsible,
   ii. Said seat means comprise a first copy of a linkage and a second copy of said linkage
   iii. said first copy of said linkage is connected to a side of said throwing game target,
   iv. said second copy of said linkage is connected to a side of said throwing game target, and
   v. a seat panel, wherein
   vi. said linkage comprises a thigh link and a calf link,
   vii. said thigh link comprises a hip end and a knee end,
   viii. said calf link comprises a knee end and a foot end,
   ix. said thigh link connects to said side of said throwing game target at said hip end of said thigh link,
   x. said knee end of said thigh link and said knee end of said calf link are connected,
   xi. a crossmember connects said knee ends of said thigh links of said copies of said linkage,
   xii. said thigh links of said copies of said linkage and said crossmember form a supportive periphery,
   xiii. a wedged foot connects said foot ends of said calf links of said copies of said linkage,
   xiv. each of said foot ends of said calf links of said copies of said linkage connect to said wedged foot at a junction, said junction being rigid
   xv. said linkage can articulate to locate said wedged foot between the ground and said throwing game target in said secondary position,
   xvi. said seat panel is disposed upon said supportive periphery,
   xvii. said seat panel comprises a seat surface, sufficient to support loads applied to said seat panel, and
   xviii. said seat panel comprises slats.

2. An apparatus, comprising:

a substantially rigid planar target area, rigid meaning having rigidity sufficient to resist yielding or deflecting or deforming in shape away from a planar geometry under force of many impacts of thrown projectiles and the weight of projectiles thereby located on the substantially rigid planar target area, a target feature disposed on the target area, the target feature being one adapted to receive thrown projectiles such that a projectile striking a target feature is limited against further translatory movement on the planar target area, the target feature being one selected from a list comprising an aperture a primary support mechanism, adapted to selectably and alternately position the apparatus into at least one primary position having non-parallel angular inclination with respect to the ground, a secondary support mechanism, adapted to selectably and alternately position said apparatus into at least one secondary position, the secondary position being of significantly increased angle to the ground, with respect to the primary position, and An alternately erectable seat mechanism, adapted to selectably and alternately arrange the apparatus to be a chair, the seat mechanism comprising a seat panel located by a linkage that is assembled and arranged to articulate about the apparatus to form a support truss structure with respect to the target area, such that the target area and seat panel form the chair, the target area being a plane of support for the back of a person, and the seat panel being at least one plane of support for the upper leg and posterior of a person, wherein the linkage is adapted to form a support truss structure only when the apparatus is in a secondary position, such that the combination of the formation of the linkage into the support truss structure and secondary position of the apparatus render the apparatus into an arrangement that is a chair mode, a chair mode being exclusive to a target mode, by a target mode being one in which the apparatus is positioned into a primary position, and not a secondary position, wherein the linkage forms the support truss structure by the linkage being hingedly anchored to the apparatus by comprising at least two pivoting link members and a wedge foot that is adapted to engage the lower end of the apparatus, wherein at least one link is angularly positioned in a range between perfectly horizontal to only a small angle with respect to parallel to the ground such that it is adapted to be direct support for forces applied to the seat panel.

* * * * *